US008320791B2

(12) United States Patent
Mochizuki

(10) Patent No.: US 8,320,791 B2
(45) Date of Patent: Nov. 27, 2012

(54) INTERMEDIATE TRANSFER BELT, A CONVEYANCE BELT MEMBER, AND AN IMAGE FORMING APPARATUS COMPRISING THE SAME

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 535 days.

(21) Appl. No.: 12/478,631

(22) Filed: Jun. 4, 2009

(65) Prior Publication Data

US 2009/0304411 A1 Dec. 10, 2009

(30) Foreign Application Priority Data

Jun. 6, 2008 (JP) ..... 2008-149365

(51) Int. Cl.
*G03G 15/16* (2006.01)

(52) U.S. Cl. ..... 399/101

(58) Field of Classification Search ..... 399/101, 399/121, 303

See application file for complete search history.

(56) References Cited

U.S. PATENT DOCUMENTS 6,885,842 B2 * 4/2005 Sawai ..... 399/302
2005/0201775 A1 * 9/2005 Ikeda ..... 399/101
2006/0088338 A1 * 4/2006 Matsuda et al. ..... 399/167
2006/0251444 A1 * 11/2006 Ozawa et al. ..... 399/101
2008/0317495 A1 * 12/2008 Hyakutake et al. ..... 399/101

FOREIGN PATENT DOCUMENTS

JP 10-186786 7/1998
JP 2001-337538 12/2001
JP 2004-325932 A 11/2004
JP 2008-14989 1/2008

OTHER PUBLICATIONS

Translation of Ono (Pub No. JP 2001-337,538 A) Pub Date Dec. 7, 2001. Listed in IDS and translation provided by Applicant.*

Korean Office Action for counterpart Korean application 10-2009-49822.

* cited by examiner

*Primary Examiner* — Walter L Lindsay, Jr.
*Assistant Examiner* — Rodney Bonnette
(74) *Attorney, Agent, or Firm* — Canon U.S.A., Inc. IP Division

(57) ABSTRACT

An image forming apparatus includes a first drive member located downstream of an image bearing member and upstream of a transfer portion and a second drive member located downstream of the transfer portion with respect to a direction of conveying a recording material on a conveyance belt member and configured to apply a driving force to the conveyance belt member.

11 Claims, 8 Drawing Sheets

INTERMEDIATE TRANSFER BELT, A CONVEYANCE BELT MEMBER, AND AN IMAGE FORMING APPARATUS COMPRISING THE SAME

BACKGROUND OF THE INVENTION

1. Field of the Invention

The present invention relates to an image forming apparatus using an electrophotographic method or an electrostatic recording method. In particular, the present invention relates to an image forming apparatus including an intermediate transfer belt and a transfer conveyance belt.

2. Description of the Related Art

Conventionally, there is a color image forming apparatus which can form a full-color image using a direct transfer method or an intermediate transfer method.

The intermediate transfer method enables the image forming apparatus to easily form an image on various types of recording materials, so that selectivity of recording materials can be improved. In the intermediate transfer method, a toner image formed on a single photosensitive drum or a plurality of photosensitive drums is once transferred (i.e., primary transferred) to the intermediate transfer belt, i.e., a rotatable belt member. The toner image on the intermediate transfer belt is then transferred (secondary transferred) to the recording material.

FIG. 7 illustrates a configuration of an image forming apparatus using the intermediate transfer method. Referring to FIG. 7, the image forming apparatus includes four process units, i.e., image forming units, corresponding to four colors, i.e., yellow, magenta, cyan, and black, respectively. The image forming apparatus further includes the following: photosensitive drums (image bearing member) 10*a*, 10*b*, 10*c*, and 10*d*, charging devices 20*a*, 20*b*, 20*c*, and 20*d*, exposure units 30*a*, 30*b*, 30*c*, and 30*d*, developing devices 40*a*, 40*b*, 40*c*, and 40*d*, an intermediate transfer belt 510, primary transfer members 530*a*, 530*b*, 530*c*, and 530*d*, photosensitive drum cleaners 60*a*, 60*b*, 60*c*, and 60*d*, secondary transfer members 560 and 570, an intermediate transfer belt drive roller 520, and a fixing device 70.

In an image forming process, the charging devices 20*a*, 20*b*, 20*c*, and 20*d* uniformly charge the photosensitive drums 10*a*, 10*b*, 10*c*, and 10*d*, respectively. The exposure units 30*a*, 30*b*, 30*c*, and 30*d* then expose the photosensitive drums 10*a*, 10*b*, 10*c*, and 10*d* with a light beam modulated according to an image signal, so that electrostatic latent images are formed on the photosensitive drums 10*a*, 10*b*, 10*c*, and 10*d*.

The developing devices 40*a*, 40*b*, 40*c*, and 40*d* develop the electrostatic latent images to form toner images on the photosensitive drums 10*a*, 10*b*, 10*c*, and 10*d*. The toner images are then sequentially transferred to the intermediate transfer belt 510 by applying a transfer bias on the primary transfer members 530*a*, 530*b*, 530*c*, and 530*d*. The toner remaining on the photosensitive drums 10*a*, 10*b*, 10*c*, and 10*d* after the image transfer is collected by the photosensitive drum cleaners 60*a*, 60*b*, 60*c*, and 60*d*.

The images that are sequentially superposed on the intermediate transfer belt 510 from the photosensitive drums 10*a*, 10*b*, 10*c*, and 10*d* are then transferred to a recording material P by applying a secondary transfer bias between the secondary transfer members 560 and 570. The fixing device 70 fixes the toner image transferred to the recording material P, so that a full color image can be acquired.

Among image forming apparatuses using the intermediate transfer belt as described above, there is an apparatus which includes a transfer conveyance belt for conveying the recording material (refer to Japanese Patent Application Laid-Open No. 2008-14989). By using both the intermediate transfer belt and the transfer conveyance belt, recording materials such as thin paper can be stably conveyed, so that a stable image forming process can be performed on recording materials of greater diversity.

FIG. 8 illustrates an image forming apparatus employing an intermediate transfer belt and a transfer conveyance belt. Referring to FIG. 8, the image forming apparatus includes four process units, i.e., image forming units, corresponding to four colors, i.e., yellow, magenta, cyan, and black. The image forming apparatus further includes the following: photosensitive drums (image bearing member) 10*a*, 10*b*, 10*c*, and 10*d*, charging devices 20*a*, 20*b*, 20*c*, and 20*d*, exposure units 30*a*, 30*b*, 30*c*, and 30*d*, developing devices 40*a*, 40*b*, 40*c*, and 40*d*, an intermediate transfer belt 510, an intermediate transfer belt drive roller 520, primary transfer members 530*a*, 530*b*, 530*c*, and 530*d*, photosensitive drum cleaners 60*a*, 60*b*, 60*c*, and 60*d*, a transfer conveyance belt 910, a transfer conveyance belt drive roller 920, secondary transfer members 560 and 570, an intermediate transfer belt drive roller 520, and a fixing device 70.

In the image forming process, an image is formed on the intermediate transfer belt 510, similarly as in the above-described image forming apparatus using the intermediate transfer method. The recording material P is then mounted on the transfer conveyance belt 910 and conveyed to a secondary transfer nip N2. By applying a secondary transfer bias between the secondary transfer members 560 and 570, the toner image on the intermediate transfer belt 510 is transferred to the recording material P at the secondary transfer nip N2. The recording material P to which the image is transferred is separated from the transfer conveyance belt 910 in the vicinity of the transfer conveyance belt drive roller 920. The fixing device 70 then fixes the toner image on the recording material P, so that a full color image can be acquired.

However, in the above-described conventional image forming apparatus using the intermediate transfer belt and the transfer conveyance belt, problems may occur as described below, depending on the arrangement of the drive rollers 520 and 920.

A surface of the intermediate transfer belt 510 suspended between the inner secondary transfer roller 560 and the intermediate transfer belt drive roller 520 will be referred to as Mf. Further, a surface of the transfer conveyance belt 910 suspended between the outer secondary transfer roller 570 and the transfer conveyance belt drive roller 920 will be referred to as Mh.

Moreover, the rotational speeds of the drive rollers 520 and 920 are set so that the moving speed of the intermediate transfer belt 510 becomes greater than the moving speed of the transfer conveyance belt 910. In such a case, the transfer conveyance belt 910 applies a force on the intermediate transfer belt 510 in a direction of reducing the rotational speed of the intermediate transfer belt 510 at the secondary transfer nip N2. A pulling force is thus applied on the surface Mf of the intermediate transfer belt 510. As a result, the intermediate transfer belt 510 is firmly wound around the intermediate transfer belt drive roller 520, so that the intermediate transfer belt 510 does not slip.

However, at the same time, the intermediate transfer belt 510 applies a force on the transfer conveyance belt 910 in a direction of increasing the rotational speed of the transfer conveyance belt 910 at the secondary transfer nip N2. As a result, the surface Mh of the transfer conveyance belt 910 becomes slackened. Therefore, the transfer conveyance belt 910 becomes less firmly wound around the transfer conveyance belt drive roller 920, so that the transfer conveyance belt 910 may slip and cause problems such as image expansion and contraction.

On the other hand, if the moving speed of the transfer conveyance belt 910 is set to be greater than the moving speed of the intermediate transfer belt 510, the winding of the intermediate transfer belt 510 onto the intermediate transfer belt drive roller 520 becomes unstable. As a result, color misregistration and image expansion and contraction may be generated.

As described above, since there are manufacturing variations in the radii of the drive rollers, it is difficult for the moving speed of the intermediate transfer belt 510 to be the same as the moving speed of the transfer conveyance belt 910. Further, the rotations of the drive rollers are uneven, so that the moving speed of the intermediate transfer belt 510 becomes unstable, being greater or less than the moving speed of the transfer conveyance belt 910. Such instability is generated even if the rotational speeds of the drive rollers are set so that the moving speeds of the intermediate transfer belt 510 and the transfer conveyance belt 910 become the same. As a result, the intermediate transfer belt 510 becomes more easily affected by a backlash in a driving force transmission portion such as a gear, increasing variations in the images.

Japanese Patent Application Laid-Open No. 2001-337538 discusses placing the drive roller of the intermediate transfer belt upstream of the secondary transfer portion N2 with respect to the moving direction of the intermediate transfer belt. Further, it is desirable to place the drive roller of the transfer conveyance belt downstream of the secondary transfer portion N2.

However, the problem may occur when the moving speed of the image bearing member is greater than the moving speed of the intermediate transfer belt even if the drive roller is disposed as described above. As a result, the rotation of the intermediate transfer belt becomes unstable and thus affects the rotation of the transfer conveyance belt.

Japanese Patent Application Laid-Open No. 10-186786 discusses a relationship among the rotational speed of the image bearing member, the rotational speed of the intermediate transfer belt, and the moving speed of the recording material. However, the positions of the intermediate transfer belt and the drive roller are not discussed, and the rotation becomes unstable if the transfer conveyance belt is further disposed in such configuration.

SUMMARY OF THE INVENTION

The present invention is directed to an image forming apparatus in which rotational stabilities of an image bearing member, an intermediate transfer belt, and a transfer conveyance belt (i.e., conveyance belt member) are improved.

According to an aspect of the present invention, an image forming apparatus includes an image forming unit, including a rotatable image bearing member, configured to form a toner image on the image bearing member, a rotatable intermediate transfer belt configured to carry a toner image transferred from the image bearing member, a rotatable conveyance belt member configured to contact the intermediate transfer belt and to convey a recording material, a transfer member configured to contact an inner surface of the intermediate transfer belt and to form a transfer portion to transfer a toner image on the intermediate transfer belt to the conveyed recording material, a first drive member located downstream of the image bearing member and upstream of the transfer portion with respect to a rotational direction of the intermediate transfer belt and configured to apply a driving force to the intermediate transfer belt, and a second drive member located downstream of the transfer portion with respect to a direction of conveying the recording material on the conveyance belt member and configured to apply a driving force to the conveyance belt member, wherein a moving speed of the intermediate transfer belt is greater than a moving speed of the image bearing member, and a moving speed of the conveyance belt member in a rotational direction is greater than a moving speed of the intermediate transfer belt in a rotational direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
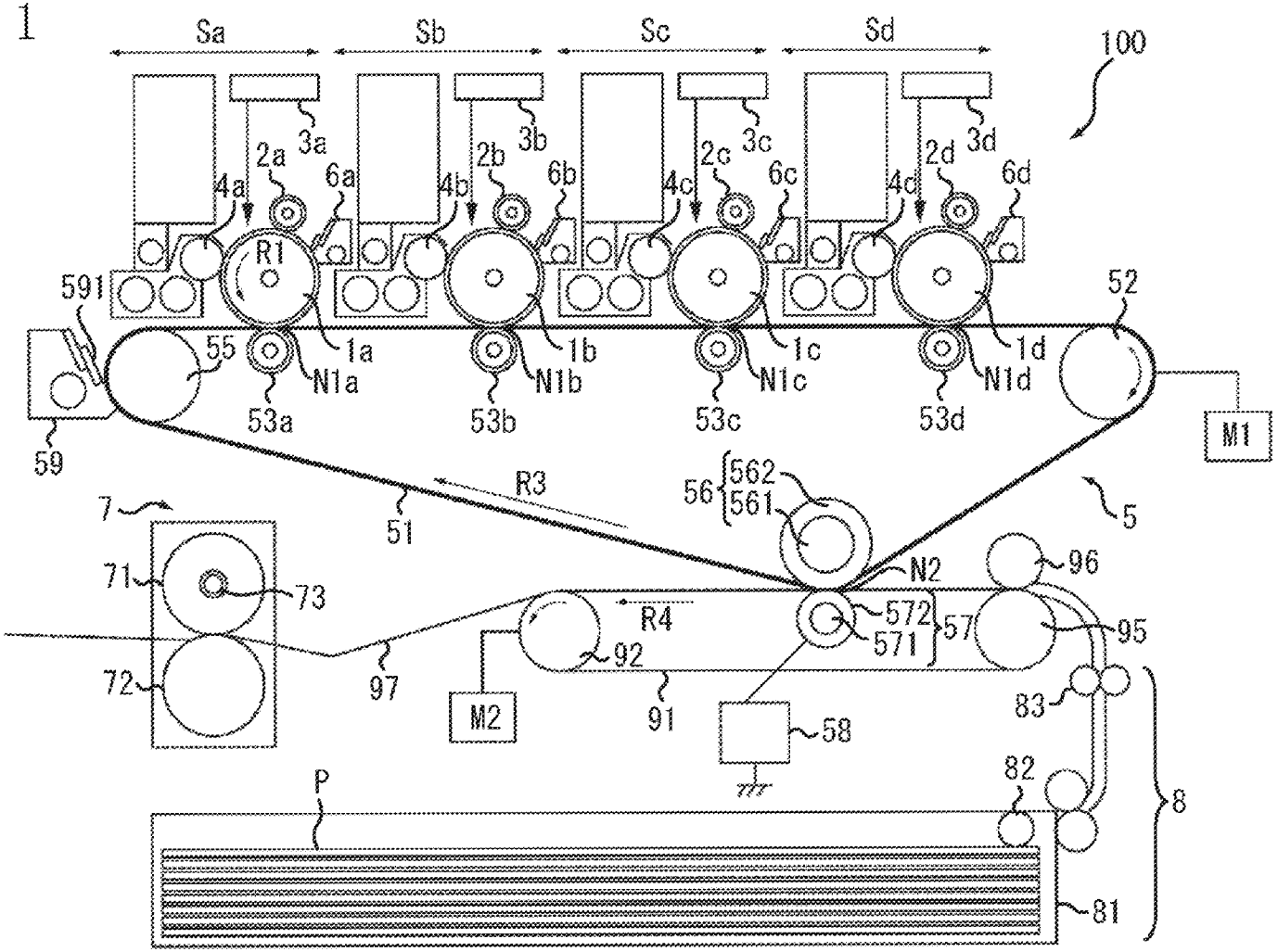
FIG. 1 illustrates a cross-sectional view of an image forming apparatus according to an exemplary embodiment of the present invention.

FIG. 1 illustrates a cross-sectional view of an image forming apparatus 100 according to an exemplary embodiment of the present invention. The image forming apparatus 100 is a full color electrophotographic image forming apparatus, which includes four photosensitive drums and employs an intermediate transfer method.

Referring to FIG. 1, the image forming apparatus 100 includes a plurality of image forming units, i.e., a first image forming unit (process unit) Sa, a second image forming unit Sb, a third image forming unit Sc, and a fourth image forming unit Sd. The image forming units Sa, Sb, Sc, and Sd form images of colors, i.e., yellow, magenta, cyan, and black, respectively.

In the present exemplary embodiment, the image forming units Sa, Sb, Sc, and Sd are similarly configured except for the color of the toner used in each image forming unit. Herein-after, unless it is necessary to distinguish an image forming unit from other image forming units, the image forming units will be collectively described below by omitting the letters a, b, c, and d that indicate an element using a toner of a different color.

The image forming unit S includes a photosensitive drum 1 as a rotatable image bearing member. A charging roller 2, i.e., a primary charging device, a laser scanner 3, i.e., an exposure device, a developing device 4, i.e., a developing unit, and a drum cleaner 6, i.e., a cleaning device of the image bearing member, are sequentially disposed around the photosensitive drum 1, along a rotational direction of the photosensitive drum 1. Further, an intermediate transfer belt 51, i.e., a rotational belt member, is disposed to be in contact with the photosensitive drums 1*a*, 1*b*, 1*c*, and 1*d* of the image forming units Sa, Sb, Sc, and Sd.

The intermediate transfer belt 51 is extended around an intermediate transfer belt drive roller 52, a driven roller 55, and an inner secondary transfer roller 56, i.e., a plurality of supporting members. The intermediate transfer belt drive roller 52, i.e., a first drive member, transmits a driving force to the intermediate transfer belt 51, so that the intermediate transfer belt 51 moves around in a direction indicated by an arrow R3 illustrated in FIG. 1. A motor M1, which is a drive source, provides the driving force to the intermediate transfer belt drive roller 52.

Further, primary transfer rollers 53*a*, 53*b*, 53*c*, and 53*d*, i.e., primary transfer members, are disposed inside the inner peripheral surface side of the intermediate transfer belt 51 opposite the photosensitive drums 1*a*, 1*b*, 1*c*, and 1*d*. The primary transfer rollers 53*a*, 53*b*, 53*c*, and 53*d* bias the intermediate transfer belt 51 towards the photosensitive drums 1*a*, 1*b*, 1*c*, and 1*d*. As a result, primary transfer portions (i.e., primary transfer nips) N1*a*, N1*b*, N1*c*, and N1*d* are formed, at which the photosensitive drums 1*a*, 1*b*, 1*c*, and 1*d* are in contact with the intermediate transfer belt 51.

Further, an outer secondary transfer roller 57, i.e., a secondary transfer member, is disposed outside the outer peripheral surface side of the intermediate transfer belt 51 opposite the inner secondary transfer roller 56, i.e., a secondary transfer member. The outer secondary transfer roller 57 is disposed inside a transfer conveyance belt 91, so that a secondary transfer nip N2, i.e., a secondary transfer portion, is formed.

The intermediate transfer belt 51 passes by the photosensitive drums 1*a*, 1*b*, 1*c*, and 1*d*, so that images formed on the photosensitive drums 1*a*, 1*b*, 1*c*, and 1*d* at the image forming units Sa, Sb, Sc, and Sd are sequentially overlaid and transferred to the intermediate transfer belt 51. The images transferred on the intermediate transfer belt 51 are further transferred to a recording material P, such as paper, at the secondary transfer portion N2. More specifically, a toner image on the image bearing member is transferred to the intermediate transfer belt 51, and the toner image transferred to the intermediate transfer belt 51 is then transferred to the recording material P.

Figure 2:
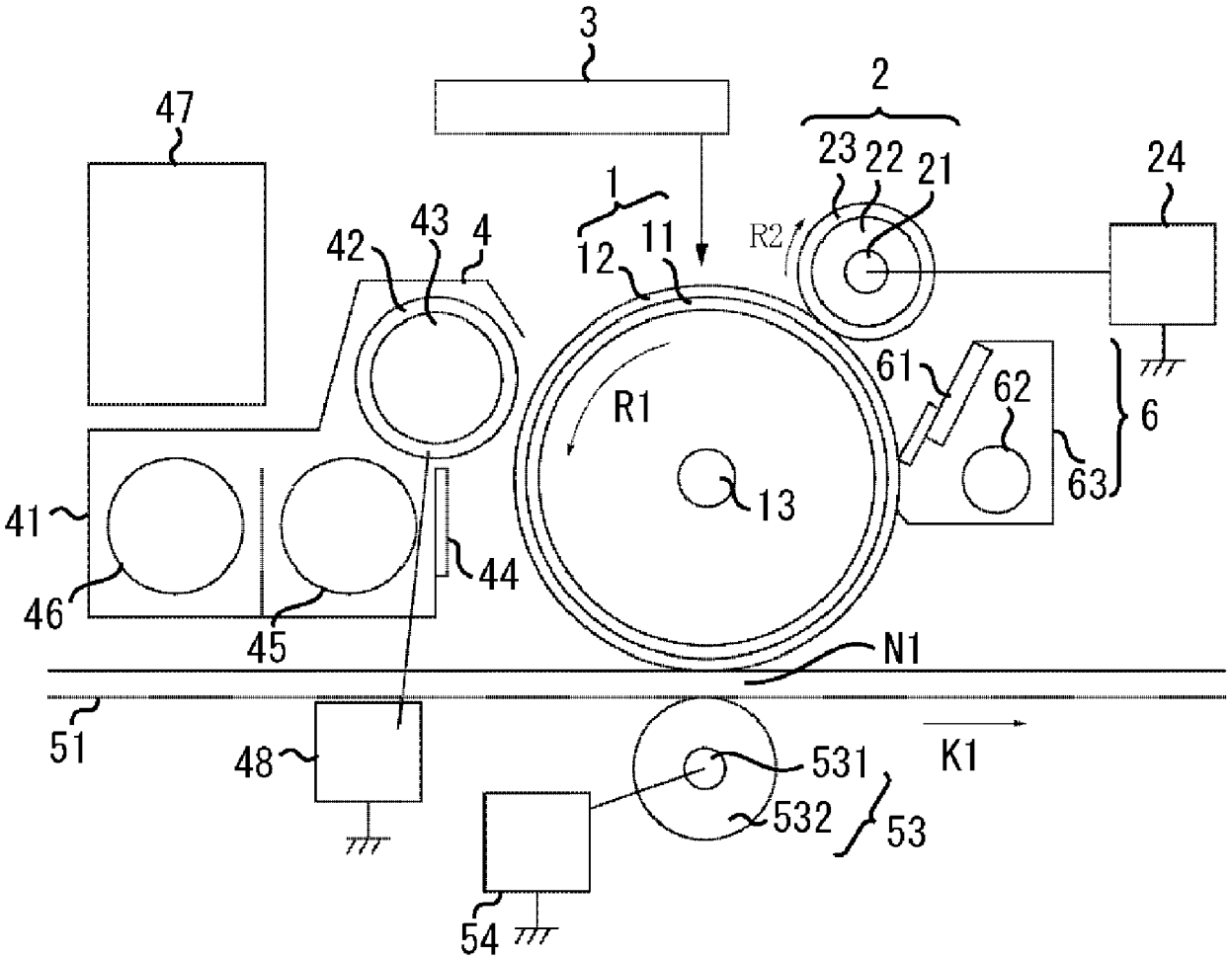
FIG. 2 illustrates a detailed cross-sectional view of an image forming unit of the image forming apparatus illustrated in FIG. 1.

FIG. 2 illustrates the image forming unit S in detail.

Referring to FIG. 2, the photosensitive drum 1 is rotatably supported by the body of the image forming apparatus. The photosensitive drum 1 is a cylindrical electrophotographic photosensitive member, which basically includes a conductive base 11, such as aluminum, and a photoconductive layer 12 formed on the outer periphery of the conductive base 11. The photosensitive drum 1 also includes a fulcrum shaft 13 at the center. A drive unit (not illustrated) rotary drives the photosensitive drum 1 around the fulcrum shaft 13 in a direction indicated by an arrow R1 illustrated in FIG. 2. In the present exemplary embodiment, the drive unit for the photosensitive drum 1 is configured independently from a drive unit for the intermediate transfer belt 51.

The charging roller 2, i.e., a primary charging member, is disposed above the photosensitive drum 1 as viewed in FIG. 2. The charging roller 2 contacts the surface of the photosensitive drum 1 and uniformly charges the surface of the photosensitive drum 1 to a predetermined polarity and potential. In the present exemplary embodiment, the photosensitive drum 1 is negatively-charged. The charging roller 2 includes a metal core 21 positioned at the center, a low-resistivity conductive layer 22 formed on the outer periphery of the metal core 21, and a mid-resistivity conductive layer 23. The charging roller 2 is of a roller form.

Both ends of the metal core 21 of the charging roller 2 are rotatably supported by bearing members (not illustrated). Further, the charging roller 2 is placed parallel to the photosensitive drum 1. The bearing members at both ends of the metal core 21 are biased towards the photosensitive drum 1 by a pressing unit (not illustrated). As a result, the charging roller 2 press-contacts the surface of the photosensitive drum 1 to apply a predetermined pressing force on the photosensitive drum 1.

The charging roller 2 is rotary driven in a direction indicated by an arrow R2 illustrated in FIG. 2, along with the rotation of the photosensitive drum 1 in the direction indicated by the arrow R1 illustrated in FIG. 2. A charging bias power source 24, i.e., a charging bias output unit, applies charging bias voltage on the charging roller 2. The surface of the photosensitive drum 1 is thus contact charged.

The laser scanner 3 is disposed downstream of the charging roller 2 with respect to the rotational direction of the photosensitive drum 1. The laser scanner 3 scan-exposes the photosensitive drum 1 by switching the laser beam on and off according to the image information. As a result, an electrostatic image (latent image) according to the image information is formed on the photosensitive drum 1.

The developing device 4 is disposed downstream of the laser scanner 3 with respect to the rotational direction of the photosensitive drum 1. The developing device 4 includes a developer container 41, which accommodates a two-component developer including nonmagnetic toner particles (i.e., toner) and magnetic carrier particles (carrier) as a developer. A developing sleeve 42, i.e., a developer bearing member, is rotatably disposed inside an opening in the developer container 41 opposite the photosensitive drum 1.

A magnetic roller 43, i.e., a magnetic field generation unit, is fixedly disposed to be non-rotatable with respect to the rotation of the developing sleeve 42. The two-component developer is carried on the developing sleeve 42 by the magnetic field formed by the magnet roller 43. Further, a regulating blade 44, which is a developer regulating member that regulates and thins the two-component developer carried on the developing sleeve 42, is disposed below the developing sleeve 42 as viewed in FIG. 2. The developer container 41 is internally divided into a developing chamber 45 and an agitating chamber 46, and a supply chamber 47 containing the supply toner is disposed above the developing container 41 as viewed in FIG. 2.

The thin layer of the two-component developer formed on the developing sleeve 42 is conveyed to the developing area opposite the photosensitive drum 1 by the rotation of the developing sleeve 42. At the developing area, the magnetic force of the main developing magnetic pole of the magnet roller 43 located in the developing area causes the two-component developer on the developing sleeve 42 to stand like the ears of grain to form a magnetic brush. The magnetic brush rubs the surface of the photosensitive drum 1, while a developing bias power source 48, i.e., a developing bias output unit, applies a developing bias voltage on the developing sleeve 42. As a result, the toner attached to the carrier forming the ears of the magnetic brush is attached to the exposed portion of the electrostatic latent image on the photosensitive drum 1, to form a toner image.

In the present exemplary embodiment, a reverse developing system is employed in forming the toner image on the photosensitive drum 1. More specifically, the toner charged to the same polarity as the charging polarity of the photosensitive drum 1 is attached to the region of the photosensitive drum 1 whose potential is reduced by being exposed.

A primary transfer roller 53 is disposed below the photosensitive drum 1, as viewed in FIG. 2, downstream of the developing device 4 with respect to the rotational direction of the photosensitive drum 1. The primary transfer roller 53 includes a metal core 531 and a conductive layer 532 cylindrically-formed on the outer periphery of the metal core 531. Both ends of the primary transfer roller 53 are biased towards the photosensitive drum 1 by pressing members (not illustrated) such as a spring. The conductive layer 532 of the primary transfer roller 53 thus press-contacts the surface of the photosensitive drum 1 via the intermediate transfer belt 51 with a predetermined pressing force on the photosensitive drum 1. Further, the metal core 531 is connected to a primary transfer bias power source 54, i.e., a primary transfer bias output unit.

A primary transfer portion N1 formed between the photosensitive drum 1 and the primary transfer roller 53 nips the intermediate transfer belt 51. The primary transfer roller 53 contacts the inner peripheral surface of the intermediate transfer belt 51 and rotates along with the movement of the intermediate transfer belt 51.

In the image forming process, the primary transfer bias power source 54 applies a primary transfer bias voltage on the primary transfer roller 53. The primary transfer bias voltage is opposite in polarity (i.e., a second polarity: a positive charging polarity in the present exemplary embodiment) to the normal charging polarity (i.e., a first polarity: a negative charging polarity in the present exemplary embodiment) of the toner. An electric field which acts to move the toner of the first polarity from the photosensitive drum 1 to the intermediate transfer belt 51 is thus formed between the primary transfer roller 53 and the photosensitive drum 1. As a result, the toner image on the photosensitive drum 1 is transferred (primary transferred) to the surface of the intermediate transfer belt 51.

A drum cleaner 6 removes adhered matter such as toner remaining on the surface of the photosensitive drum 1 after the primary transfer process (i.e., primary transfer residual toner). The drum cleaner 6 includes a cleaning blade 61, i.e., a cleaning member, a conveyance screw 62, and a drum cleaner housing 63. A pressing unit (not illustrated) causes the cleaning blade 61 to contact the photosensitive drum 1 at a predetermined angle and pressing force. The cleaning blade 61 scrapes off and removes the toner remaining on the surface of the photosensitive drum 1, which is accumulated in the drum cleaner housing 63. The accumulated toner is conveyed to the conveyance screw 62 and discharged to a waste toner accommodating portion (not illustrated).

Referring to FIG. 1, an intermediate transfer unit 5 is disposed below the photosensitive drums 1*a*, 1*b*, 1*c*, and 1*d* as viewed in FIG. 1. The intermediate transfer unit 5 includes the intermediate transfer belt 51, the primary transfer rollers 53*a*, 53*b*, 53*c*, and 53*d*, the inner secondary transfer roller 56, the outer secondary transfer roller 57, and an intermediate transfer belt cleaner 59. The inner secondary transfer roller 56 is electrically grounded. Further, the outer secondary transfer roller 57 is connected to the secondary transfer bias power source 58, i.e., a secondary transfer bias output unit. The inner secondary transfer roller 56 is in contact with the inner peripheral surface of the intermediate transfer belt 51 and rotates along with the movement of the intermediate transfer belt 51.

When the image forming apparatus forms a full color image, a toner image of each color is formed on each of the photosensitive drums 1*a*, 1*b*, 1*c*, and 1*d* in the first image portion Sa, the second image portion Sa, the third image portion Sa, and the fourth image portion Sa, respectively. Each of the primary transfer rollers 53*a*, 53*b*, 53*c*, and 53*d*, disposed opposite each of the photosensitive drums 1*a*, 1*b*, 1*c*, 1*d* via the intermediate transfer belt 51, apply a primary transfer bias on the toner images of each color. The toner images are thus sequentially transferred (primary transferred) to the intermediate transfer belt 51. The transferred toner image is then conveyed to the secondary transfer portion N2 by the rotation of the intermediate transfer belt 51.

On the other hand, by this time, a recording material conveyance portion 8 conveys the recording material P to the secondary transfer portion N2. More specifically, a pick up roller 82 picks up the recording material P sheet by sheet from a cassette 81 in the recording material conveyance portion 8. The recording material P is then conveyed by the conveyance roller 83 to the vicinity of a transfer conveyance belt 91, i.e., a conveyance belt member. The recording material P is attracted to the surface of the transfer conveyance belt 91 by an attraction current flowing between an attraction unit 96 and the driven roller 95. The attraction current is generated by an attraction bias applied on the attraction unit 96 by a bias applying unit (not illustrated). A stable image without failure can thus be acquired in the secondary transfer by the attraction unit 96 attracting the recording material P to the transfer conveyance belt 91 before the recording material P enters the secondary transfer nip N2.

The transfer conveyance belt drive roller 92, i.e., a secondary drive member, transmits a driving force to the transfer conveyance belt 91, which rotary moves in a direction indicated by an arrow R4 illustrated in FIG. 1. A motor M2, i.e., a drive source, applies the driving force to the transfer conveyance belt drive roller 92. The recording material P attracted to the surface of the transfer conveyance belt 91 is thus conveyed to the secondary transfer portion N2.

In the image forming process performed in the present exemplary embodiment, the secondary transfer bias power source 58 applies a secondary transfer bias voltage on the outer secondary transfer roller 57. The secondary transfer bias voltage is opposite in polarity (i.e., a positive charging polarity in the present exemplary embodiment) to the normal charging polarity (i.e., a negative charging polarity in the present exemplary embodiment) of the toner. An electric field which acts to transfer the toner of normal charging polarity from the intermediate transfer belt 51 to the recording material P is thus formed between the inner secondary transfer roller 56 and the outer secondary transfer roller 57. As a result, the toner image on the intermediate transfer belt 51 is transferred (secondary transferred) to the recording material P.

The recording material P to which the toner image is transferred at the secondary transfer portion N2 is conveyed by the transfer conveyance belt 91 while being attracted to the transfer conveyance belt 91. After being stably separated from the intermediate transfer belt 51, the recording material P is separated from the transfer conveyance belt 91 in the vicinity of the transfer conveyance belt drive roller 92. The recording material P is then conveyed to a fixing device 7, i.e., a fixing unit, after being guided along a conveyance guide 97.

The intermediate transfer belt cleaner 59 removes and collects adhered matter such as toner remaining on the outer peripheral surface of the intermediate transfer belt 51 after the secondary transfer process (i.e., secondary transfer residual toner). The intermediate transfer belt cleaner 59 is similarly configured as the drum cleaner 6. The intermediate transfer belt cleaner 59 includes a cleaning blade 591, i.e., a cleaning member made of urethane rubber, which is press-contacted with the intermediate transfer belt 51, opposing the rotational direction of the intermediate transfer belt 51. The cleaning blade 591 thus applies a force on the intermediate transfer belt 51 in a direction of reducing the rotational speed of the intermediate transfer belt 51. The cleaning blade 591 can also be configured to press-contact to and separate from the intermediate transfer belt 51.

The fixing device 7 includes a fixing roller 71, i.e., a fixing member, which is rotatably disposed, and a pressing roller 72, i.e., a pressing member, which rotates while pressing onto the fixing roller 71. A heater 73 such as a halogen lamp is disposed inside the fixing roller 71. The temperature of the surface of the fixing roller 71 is adjusted by controlling the voltage applied to the heater 73.

After the recording material P is conveyed to the fixing device 7, the recording material P passes between the fixing roller 71 and the pressing roller 72 that rotate at constant speeds. The recording material P is thus pressed and heated on both sides by proximately constant pressing force and temperature. As a result, the unfixed toner image on the surface of the recording material P is melted and fixed on the recording material P, so that a full color image is formed on the recording material P.

The intermediate transfer belt 51 is formed of a dielectric resin such as polycarbonate (PC), polyethylene terephthalate (PET), and polyvinylidene-fluoride (PVDF). In the present exemplary embodiment, a polyimide (PI) resin having a volume resistivity of $10^{12}$ Ω/sq (a probe which conforms with the JIS-K6911 rule is used: applied voltage is 100V, applying time is 60 sec, under the condition of temperature=23° C. and humidity=50% RH), and a thickness of 80 μm is used as the intermediate transfer belt 51. However, this is not a limitation, and another material of different volume resistivity and thickness can be used.

The primary transfer roller 53 includes the metal core 531 having a diameter of 8 mm, and an electroconductive urethane sponge layer having a thickness of 4 mm serving as the conductive layer 532. The resistance of the primary transfer roller 53 is approximately $10^6$Ω (under the condition of temperature=23° C. and humidity=50% RH). The resistance of the primary transfer roller 53 is determined based on the relation between a voltage and a current that are measured under application of a voltage of 50 V to the metal core 531 while the transfer roller 53 is rotated at a peripheral speed of 50 mm/sec relative to the earth under a load of 500 g-wt.

The inner secondary transfer roller 56 includes the metal core 561 having a diameter of 18 mm and silicon rubber solid layer having a thickness of 7 mm serving as the conductive layer 562. The resistance of the inner secondary transfer roller 56 is approximately $1\times10^4$Ω using the same measuring method as the primary transfer roller 53.

The outer secondary transfer roller 57 includes the metal core 571 having a diameter of 8 mm and ethylene propylene diene monomer (EPDM) sponge layer having a thickness of 4 mm serving as the conductive layer 572. The resistance of the outer secondary transfer roller 57 is approximately $1\times10^7$Ω under application of a voltage of 2000 V, using the same measuring method as the primary transfer roller 53.

The transfer conveyance belt 91 can be formed of dielectric resin such as PC, PET, and PVDF, similarly as the intermediate transfer belt 51. The transfer conveyance belt 91 in the present exemplary embodiment uses a polyimide (PI) resin in which carbon black is dispersed, having a surface resistivity of $1\times10^4$ Ω/sq (a probe which conforms with the JIS-K6911 rule is used: applied voltage is 100V, applying time is 60 sec, under the condition of temperature=23° C. and humidity=50% RH), and a thickness of 80 μm. However, these are not limitations, and another material of different volume resistivity and thickness, etc., can be used.

Figure 4:
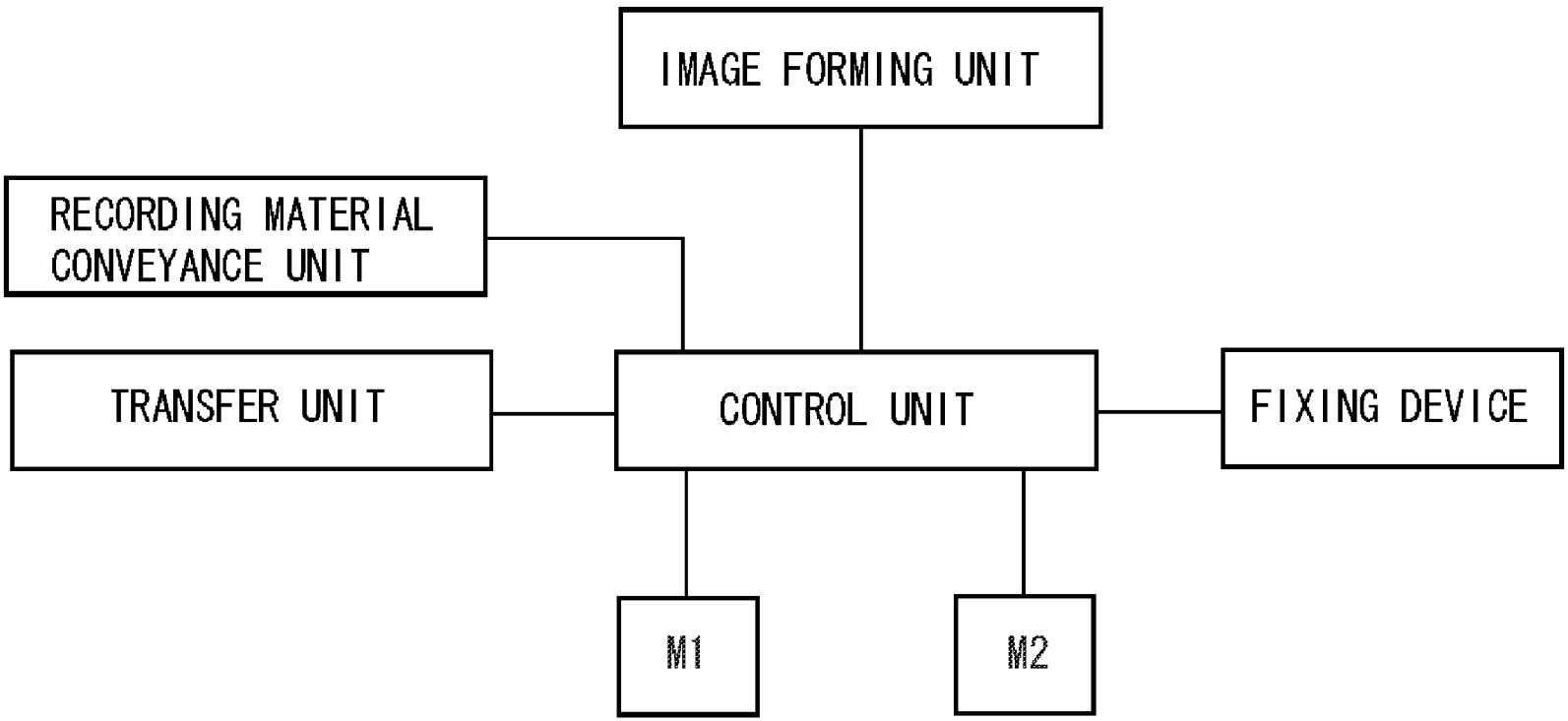
FIG. 4 is a block diagram of a control unit of the image forming apparatus illustrated in FIG. 1.

FIG. 4 is a block diagram illustrating the control unit according to the present exemplary embodiment. Referring to FIG. 4, the control unit (i.e., a central processing unit (CPU)) controls the image forming unit, the recording material conveyance unit, the transfer unit (the primary transfer portion and the secondary transfer portion), the fixing device, and the motors M1 and M2.

According to the present exemplary embodiment, the image forming apparatus includes the intermediate transfer belt 51 and the transfer conveyance belt 91. The intermediate transfer belt 51 and the transfer conveyance belt 91 are each rotary driven respectively by the intermediate transfer belt drive roller 52, i.e., a first drive member, and the transfer conveyance belt drive roller 92, i.e., a second drive member.

As described above, since there is variation in the radii of the drive rollers due to manufacturing variations, the moving speeds of the intermediate transfer belt 51 and the transfer conveyance belt 91 may deviate or vary from the aimed moving speeds. Moreover, the intermediate transfer belt 51 and the transfer conveyance belt 91 are nipped by the inner secondary transfer roller 56 and the outer secondary transfer roller 57 at the secondary transfer nip N2. Therefore, the difference between the moving speed of the intermediate transfer belt 51 and the moving speed of the transfer conveyance belt 91 becomes a load on the intermediate transfer belt 51 and the transfer conveyance belt 91 and affects the rotation of each of the intermediate transfer belt 51 and the transfer conveyance belt 91.

The above-described effect will be described below in detail with reference to FIG. 3.

Figure 3:
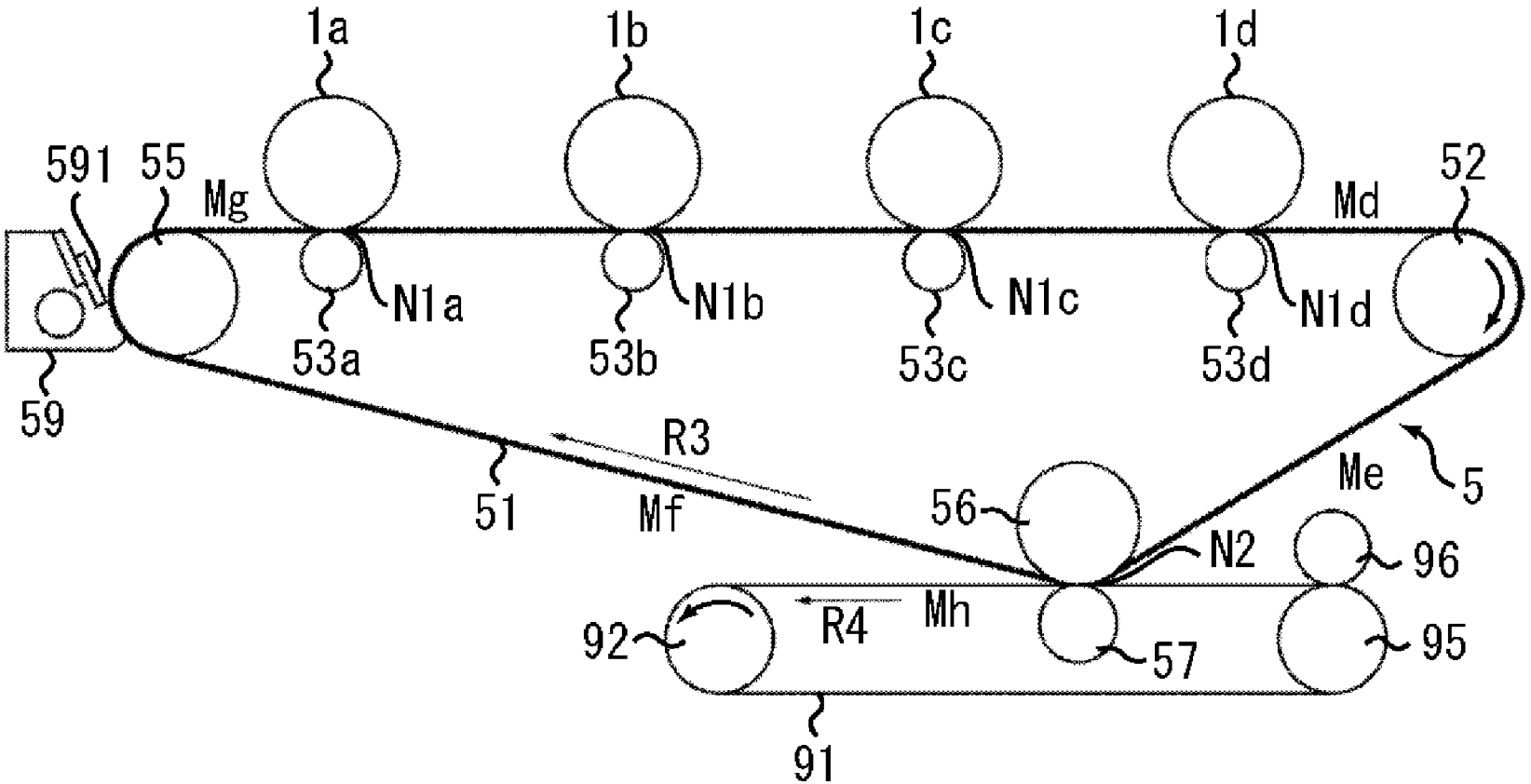
FIG. 3 illustrates a configuration of the image forming apparatus illustrated in FIG. 1.

FIG. 3 illustrates a configuration of the image forming apparatus according to the present exemplary embodiment illustrated in FIG. 1. Referring to FIG. 3, M denotes a surface of the belt suspended between suspension rollers. For example, the surface of the intermediate transfer belt 51 suspended between the intermediate transfer belt drive roller 52 and the inner secondary transfer roller 56 is referred to as Me. Further, the surface of the transfer conveyance belt 91 suspended between the transfer conveyance belt drive roller 92 and the outer secondary transfer roller 57 is referred to as Mh.

In the image forming apparatus according to the present exemplary embodiment, the intermediate transfer belt drive roller 52 is disposed downstream of the photosensitive drum 1 and upstream of the secondary transfer portion with respect to the rotational direction of the intermediate transfer belt 51. The surface Me of the intermediate transfer belt 51 formed between the intermediate transfer belt drive roller 52 and the inner secondary transfer roller 56 thus tends to be slackened.

On the other hand, the transfer conveyance belt drive roller 92 is disposed downstream of the secondary transfer portion with respect to the conveyance direction of the recording material. The surface Mh of the intermediate transfer belt 51 formed between the transfer conveyance belt drive roller 92 and the outer secondary transfer roller 57 has a tendency to be comparatively pulled. However, if the intermediate transfer belt 51 applies a force on the transfer conveyance belt 91 in a direction of increasing the rotational speed of the transfer conveyance belt 91, the surface Mh becomes slackened. As a result, the suspension of the transfer conveyance belt 91 over the transfer conveyance belt drive roller 92 becomes unstable, causing the transfer conveyance belt 91 to slip or a decrease in the tensile force. This leads to instability in the conveyance speed of the recording material P as described above, so that image expansion and contraction may occur.

According to the present exemplary embodiment, the intermediate transfer belt drive roller 52 is disposed upstream of the secondary transfer portion with respect to the rotational direction of the intermediate transfer belt 51. Further, the transfer conveyance belt drive roller 92 is disposed downstream of the secondary transfer portion with respect to the conveyance direction of the recording material. Further, the moving speed of the transfer conveyance belt 91 is set greater than the moving speed of the intermediate transfer belt 51.

By setting a relation between the moving speeds as described above, the surface Mh of the transfer conveyance belt 91 suspended between the transfer conveyance belt drive roller 92 and the outer secondary transfer roller 57 receives a force in a direction of reducing the rotational speed of the transfer conveyance belt 91 at the secondary transfer nip N2. Therefore, the surface Mh is more firmly pulled, and slipping of the transfer conveyance belt 91 becomes less easily generated.

Further, at the secondary transfer nip N2, a force in the direction of increasing the rotational speed is applied on the surface Me of the intermediate transfer belt 51 suspended between the intermediate transfer belt drive roller 52 and the inner secondary transfer roller 56. Therefore, the surface Me is pulled, and the intermediate transfer belt 51 is firmly wound around the intermediate transfer belt drive roller 52, so that slipping becomes less easily generated. More specifically, the intermediate transfer belt 51 is pulled by the transfer conveyance belt 91 at the secondary transfer nip N2 due to the difference in the peripheral speeds, so that the surface Me becomes less easily slackened.

In the present exemplary embodiment, a process speed corresponding to the moving speed of the intermediate transfer belt 51 is set at 300 mm/sec, and the moving speed of the transfer conveyance belt 91 is set at 302 mm/sec. However, it is preferable for the difference between the moving speed of the intermediate transfer belt 51 and the moving speed of the transfer conveyance belt 91 to be approximately between 0.2% and 3%. If the difference between the moving speeds becomes less than 0.2%, the difference between the moving speed of the intermediate transfer belt 51 and the moving speed of the transfer conveyance belt 91 may become reversed due to uneven rotation. On the other hand, if the difference becomes greater than 3%, an image defect in which the toner image becomes as if dragged may be generated.

Further, in the image forming apparatus according to the present exemplary embodiment, the primary transfer portion is disposed upstream of the intermediate transfer belt drive roller 52, and the secondary transfer portion is disposed downstream of the intermediate transfer belt drive roller 52. The moving speed of the photosensitive drum 1 is set lower than the moving speed of the intermediate transfer belt 51. More specifically, the moving speed of the photosensitive drum 1 is set at 298 mm/sec. By such relation between the moving speeds, a surface Md of the intermediate transfer belt 51 suspended between the photosensitive drum 1*d* and the intermediate transfer belt drive roller 52 receives a force in the direction of reducing the rotational speed of the intermediate transfer belt 51 from the photosensitive drum 1. The surfaces Md and Me of the intermediate transfer belt 51 thus apply a winding force on the intermediate transfer belt drive roller 52 from both the upstream side and the downstream side. As a result, the possibility of generating slipping can be decreased.

Further, the difference between the moving speed of the photosensitive drum 1 and the moving speed of the intermediate transfer belt 51 may be approximately between 0.2% and 3%. If the difference between the moving speeds becomes less than 0.2%, the difference between the moving speed of the photosensitive drum 1 and the moving speed of the intermediate transfer belt 51 may become reversed due to uneven rotation. On the other hand, if the difference becomes greater than 3%, an image defect in which the toner image becomes as if dragged may be generated.

Further, in the present exemplary embodiment, the intermediate transfer belt cleaner 59 is disposed downstream of the inner secondary transfer roller 56 and upstream of the photosensitive drum 1*a* with respect to the rotational direction of the intermediate transfer belt 51. The intermediate transfer belt cleaner 59 press-contacts an urethane rubber blade 591 against the intermediate transfer belt 51 opposing the rotational direction of the intermediate transfer belt 51. A force in the direction of reducing the rotational speed of the intermediate transfer belt 51 is thus applied on the intermediate transfer belt 51. As a result, the intermediate transfer belt cleaner 59 can stop the intermediate transfer belt 51 from slacking, even if the surface Mf of the intermediate transfer belt 51 receives a slacking force from the transfer conveyance belt 91 at the secondary transfer nip N2. Therefore, it can prevent an instability in the formation of a primary transfer nip N1*a* due to slacking of a surface Mg formed upstream of the photosensitive drum 1*a*, causing an image defect such as spattering in the transfer portion.

As described above, according to the present exemplary embodiment, the photosensitive drum, the intermediate transfer belt drive roller, and the secondary transfer member are disposed in this order from the upstream with respect to the rotational direction of the intermediate transfer belt. Further, the secondary transfer member and the transfer conveyance belt drive roller are disposed in this order from the upstream with respect to the rotational direction of the transfer conveyance belt. Further, the moving speed of the transfer conveyance belt is set greater than the moving speed of the intermediate transfer belt. More preferably, the moving speed of the transfer conveyance belt is set greater than the moving speed of the image bearing member. Further, it is more preferable that the cleaning member be disposed downstream of the secondary transfer member and upstream of the image bearing member with respect to the rotational direction of the intermediate transfer belt. As a result, image expansion and contraction and color misregistration due to slipping of the intermediate transfer belt and the transfer conveyance belt can be reduced in the image forming apparatus.

In the above-described exemplary embodiment, a suspension roller is not disposed between the intermediate transfer belt drive roller 52 and the inner secondary transfer roller 56. However, if a suspension roller is disposed between the intermediate transfer belt drive roller 52 and the inner secondary transfer roller 56, the suspension roller hardly exerts a braking force on the rotation of the intermediate transfer belt 51. Therefore, the present invention can be applied to such configuration including the suspension roller.

As described above, according to the present exemplary embodiment, the rotational stabilities of the intermediate transfer belt and the conveyance belt member can be improved even if there is a difference between the peripheral speed of the image bearing member and the peripheral speed of the intermediate transfer belt.

Another exemplary embodiment according to the present invention will be described below with reference to FIG. 5. The configuration of the image forming apparatus according to the present exemplary embodiment is similar to the configuration of the first exemplary embodiment, except for the arrangement of the drive rollers of each belt and the relation between the speeds of each of the belts. Therefore, detailed description will be omitted, and the difference will be described.

Figure 5:
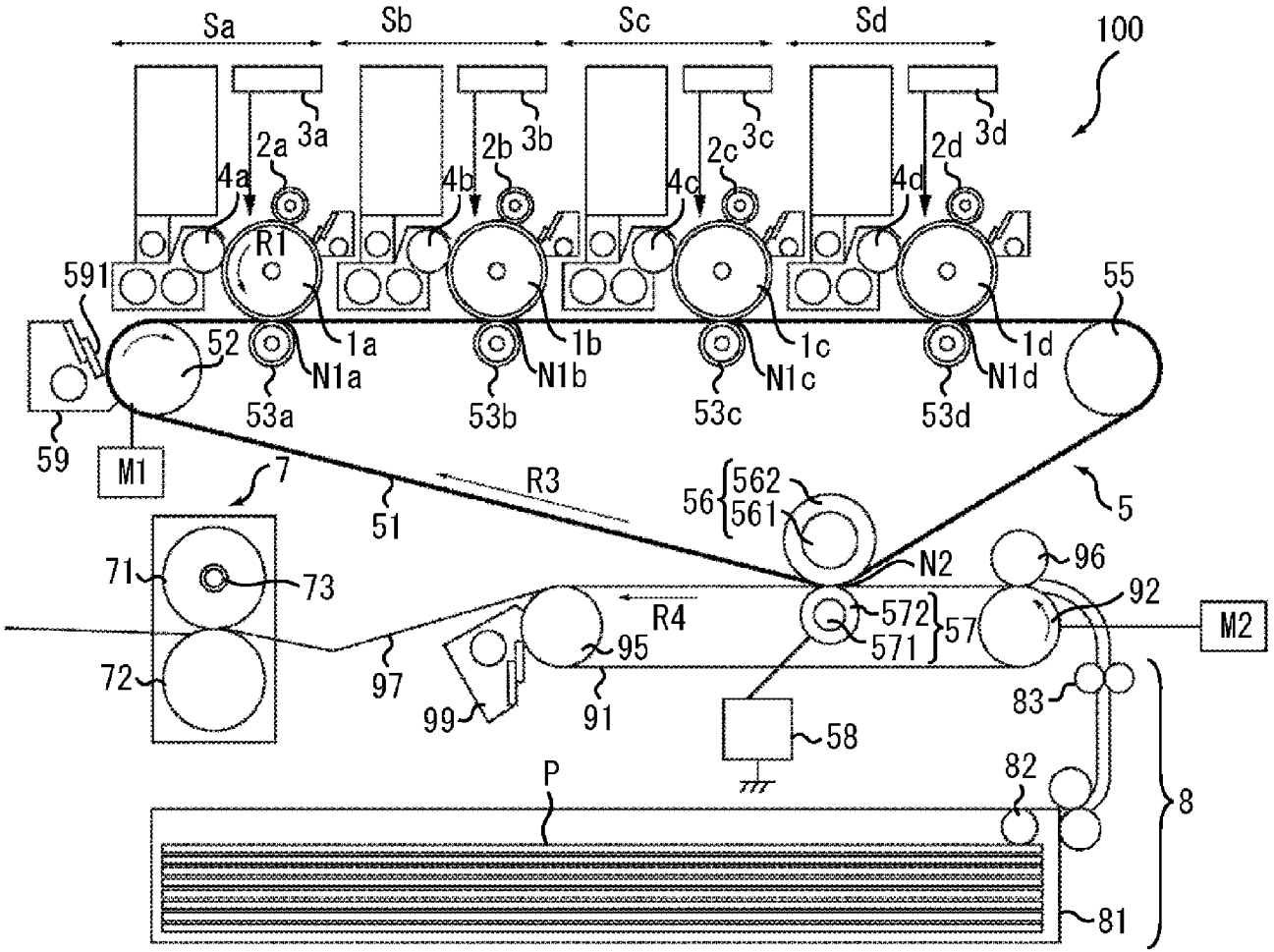
FIG. 5 illustrates a cross-sectional view of an image forming apparatus according to another exemplary embodiment of the present invention.

Referring to FIG. 5, the first image forming unit Sa, the second image forming unit Sb, the third image forming unit Sc, and the fourth image forming unit Sd, i.e. processing units as image forming units, are disposed in the image forming apparatus. The image forming units Sa, Sb, Sc, and Sd correspond to the colors, which are yellow, magenta, cyan, and black, respectively. Further, the photosensitive drums 1*a*, 1*b*, 1*c*, and 1*d*, the charging devices 2*a*, 2*b*, 2*c*, and 2*d*, the exposure units 3*a*, 3*b*, and 3*c*, the developing units 4*a*, 4*b*, 4*c*, and 4*d*, the intermediate transfer belt 51, the primary transfer members 53*a*, 53*b*, 53*c*, and 53*d*, and the photosensitive drum cleaners 6*a*, 6*b*, 6*c*, and 6*d* are disposed in the image forming apparatus.

The intermediate transfer belt 51 is extended around the intermediate transfer belt drive roller 52, the driven roller 55, and the inner secondary transfer roller 56, i.e., a plurality of supporting members. The intermediate transfer belt drive roller 52, i.e., a first drive member, transmits a driving force to the intermediate transfer belt 51, so that the intermediate transfer belt 51 moves around in a direction indicated by an arrow R3 illustrated in FIG. 5. Further, the outer secondary transfer roller 57, i.e., a secondary transfer member, is disposed on the outer peripheral surface of the intermediate transfer belt 51 opposite the inner secondary transfer roller 56, i.e., a secondary transfer member. The outer secondary transfer roller 57 and the inner secondary transfer roller 56 nip the transfer conveyance belt 91 to be described below and thus form the secondary transfer nip N2.

In a full color image forming process, color toner images are formed on the photosensitive drums 1*a*, 1*b*, 1*c*, and 1*d* in the first image forming unit Sa, the second image forming unit Sb, the third image forming unit Sc, and the fourth image forming unit Sd, respectively. The color toner images are sequentially transferred (i.e., primary transferred) to the intermediate transfer belt 51 and conveyed to the secondary transfer portion N2 along with the rotation of the intermediate transfer belt 51.

On the other hand, the recording material conveyance portion 8 conveys the recording material P to the secondary transfer portion N2. More specifically, the pick up roller 82 picks up the recording material P sheet by sheet from the cassette 81 in the recording material conveyance portion 8. The recording material P is then conveyed by the conveyance roller 83 to the vicinity of the transfer conveyance belt 91. The recording material P is attracted on the surface of the transfer conveyance belt 91 by the attraction current flowing between the attraction unit 96 and the transfer conveyance belt drive roller 92. The attraction current is generated by the attracting bias applied on the attraction unit 96 by a bias applying unit (not illustrated). A stable image without failure can thus be acquired in the secondary transfer by the attraction unit 96 attracting the recording material P on the transfer conveyance belt 91 before the recording material P enters the secondary transfer nip N2.

The transfer conveyance belt drive roller 92, i.e., a secondary drive member, transmits a driving force to the transfer conveyance belt 91, which rotary moves in a direction indicated by an arrow R4 illustrated in FIG. 5. The motor M2, i.e., a drive source, applies the drive force to the transfer conveyance belt drive roller 92. The recording material P attracted to the surface of the transfer conveyance belt 91 is thus conveyed to the secondary transfer portion N2.

The recording material P to which the toner image is transferred at the secondary transfer portion N2 is conveyed by the transfer conveyance belt 91 while being attracted to the transfer conveyance belt 91. After being stably separated from the intermediate transfer belt 51, the recording material P is separated from the transfer conveyance belt 91 in the vicinity of the transfer conveyance belt drive roller 92. The recording material P is then conveyed to the fixing device 7, i.e., a fixing unit, after being guided along the conveyance guide 97. The cleaning blade 591 disposed in the intermediate transfer belt cleaner 59, which cleans the intermediate transfer belt 51, removes and collects the toner remaining on the intermediate transfer belt 51 after the secondary transfer process.

The image forming apparatus according to the present exemplary embodiment includes the intermediate transfer belt 51 and the transfer conveyance belt 91. There is a difference between the moving speed of the intermediate transfer belt 51 and the moving speed of the transfer conveyance belt 91 caused by variation in the radii of the drive rollers that drive the belts, due to manufacturing variations. Therefore, the difference between the moving speed of the intermediate transfer belt 51 and the moving speed of the transfer conveyance belt 91 becomes a load on the intermediate transfer belt 51 and the transfer conveyance belt 91 and affects the rotation of each of the intermediate transfer belt 51 and the transfer conveyance belt 91.

The above-described effect will be described below with reference to FIG. 6.

Figure 6:
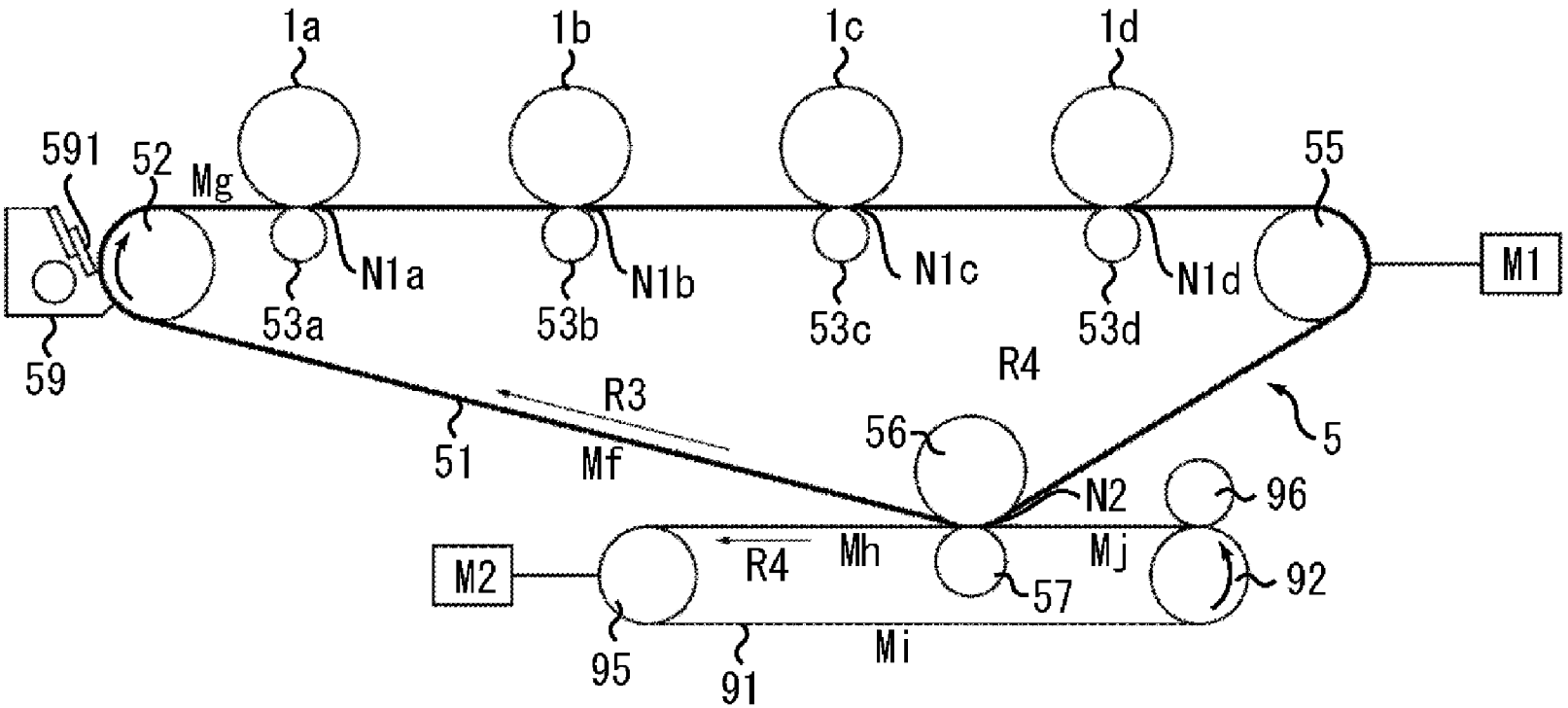
FIG. 6 illustrates a detailed cross-sectional view of an image forming unit of the image forming apparatus illustrated in FIG. 5.
Figure 7:
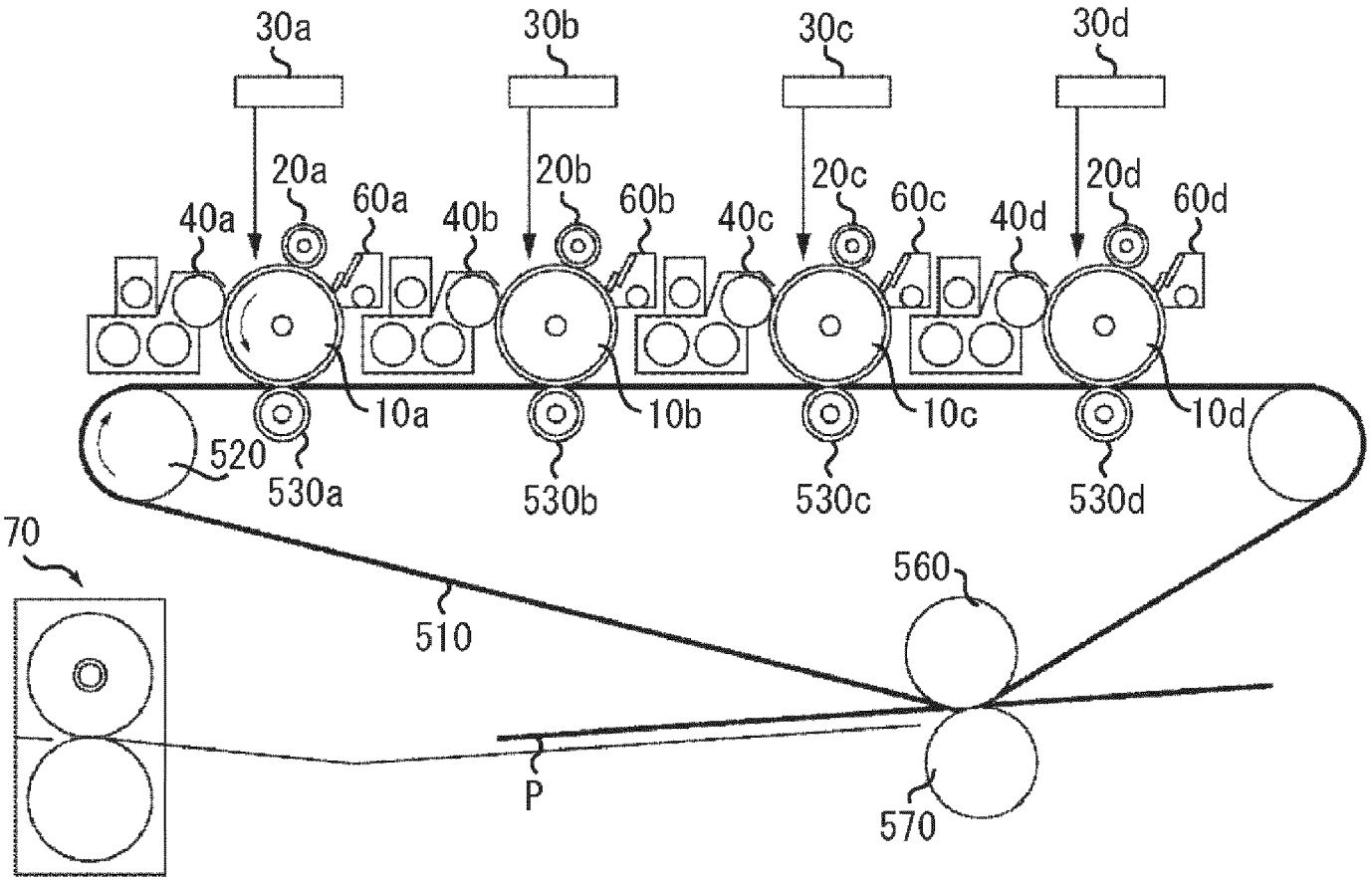
FIG. 7 PRIOR ART
FIG. 7 illustrates a cross-sectional view of a conventional image forming apparatus using the intermediate transfer method.
Figure 8:
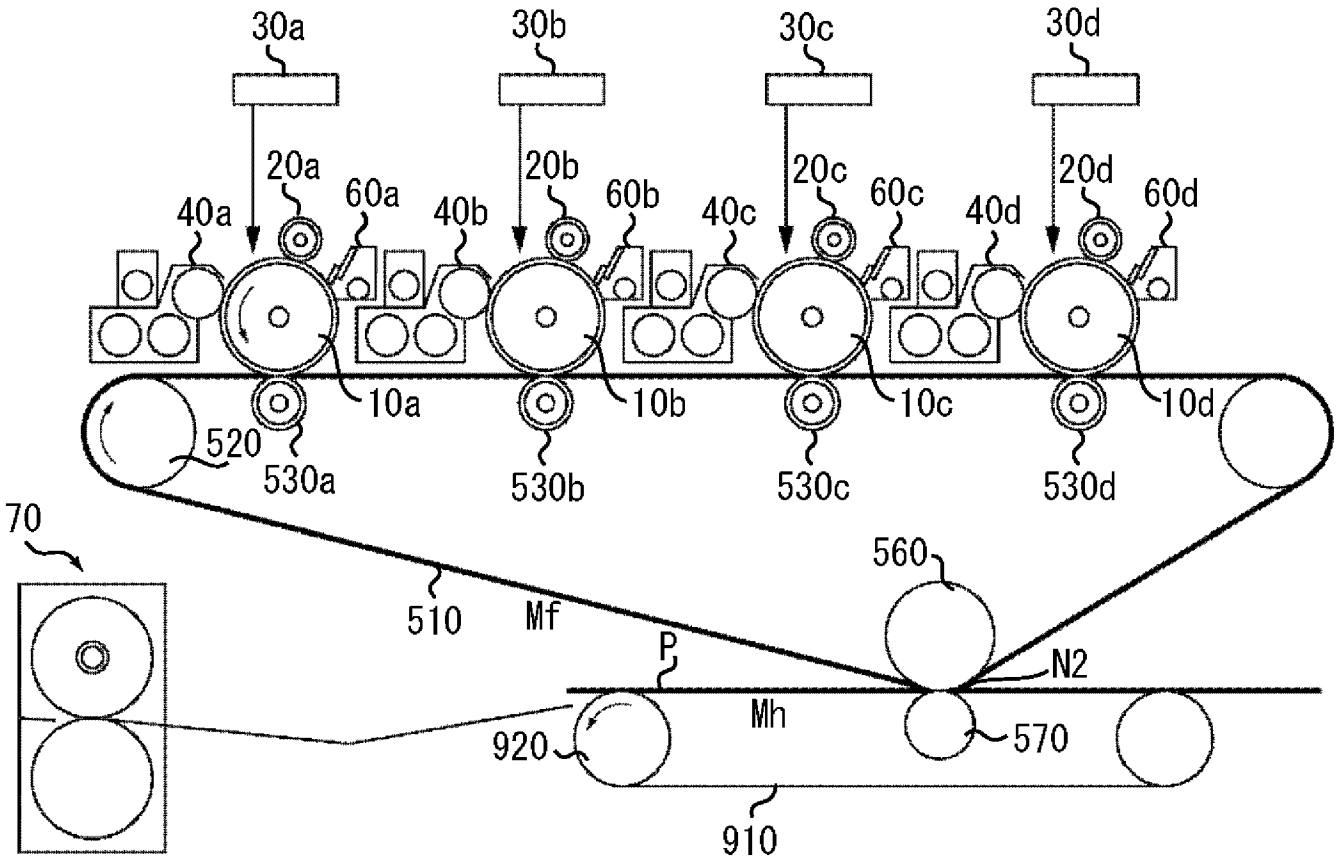
FIG. 8 PRIOR ART
FIG. 8 illustrates a cross-sectional view of a conventional image forming apparatus employing an intermediate transfer belt and a transfer conveyance belt.

FIG. 6 illustrates a configuration of the image forming apparatus according to the present exemplary embodiment. Referring to FIG. 6, a surface of the intermediate transfer belt 51 suspended between the intermediate transfer belt drive roller 52 and the inner secondary transfer roller 56 is referred to as Mf. Further, a surface of the transfer conveyance belt 91 suspended between the transfer conveyance belt drive roller 92 and the outer secondary transfer roller 57 is referred to as Mj.

In the image forming apparatus according to the present exemplary embodiment, the intermediate transfer belt drive roller 52 is disposed downstream of the secondary transfer nip N2. The surface Mf of the intermediate transfer belt 51 formed between the intermediate transfer belt drive roller 52 and the secondary transfer nip N2 has a tendency to be comparatively pulled. However, if the transfer conveyance belt 91 applies a force on the intermediate transfer belt 51 in the direction of increasing the rotational speed of the intermediate transfer belt 51 at the secondary transfer nip N2, the surface Mf becomes slacked. As a result, the suspension of the intermediate transfer belt 51 on the intermediate transfer belt drive roller 52 becomes unstable and causes the intermediate transfer belt 51 to slip, thus reducing the tensile force. As a result, problems such as color misregistration may be caused by the unstable rotation of the intermediate transfer belt 51.

On the other hand, the transfer conveyance belt drive roller 92 is disposed upstream of the secondary transfer nip N2. The surface Mj formed between the transfer conveyance belt drive roller 92 and the secondary transfer nip N2 becomes easily slackened.

According to the present exemplary embodiment, the intermediate transfer belt drive roller 52 is disposed downstream of the secondary transfer nip N2 in the image forming apparatus including the intermediate transfer belt 51 and the transfer conveyance belt 91. Further, the transfer conveyance belt drive roller 92 is disposed upstream of the secondary transfer nip N2. Moreover, the moving speed of the intermediate transfer belt 51 is set greater than the moving speed of the transfer conveyance belt 91, so that the above-described problem can be reduced.

By setting the above-described relation between the moving speeds, a force in the direction of reducing the rotational speed is applied on the surface Mf of the intermediate transfer belt 51 suspended between the intermediate transfer belt drive roller 52 and the inner secondary transfer roller 56, at the secondary transfer nip N2. As a result, the intermediate transfer belt 51 is pulled, so that the intermediate transfer belt 51 is firmly wound around the intermediate transfer belt drive roller 52, and slipping of the intermediate transfer belt 51 becomes less easily generated.

Further, at the secondary transfer nip N2, a force in the direction of increasing the rotational speed is applied on the surface Mj of the transfer conveyance belt 91 suspended between the transfer conveyance belt drive roller 92 and the outer secondary transfer roller 57. As a result, the surface Mj is pulled, so that the transfer conveyance belt 91 is firmly wound around the transfer conveyance belt drive roller 92, and slipping of the transfer conveyance belt 91 becomes less easily generated.

More specifically, in the present exemplary embodiment, the process speed corresponding to the moving speed of the intermediate transfer belt 51 is set at 300 mm/sec, and the moving speed of the transfer conveyance belt 91 is set at 298 mm/sec. However, the difference between the moving speed of the intermediate transfer belt 51 and the moving speed of the transfer conveyance belt 91 may be approximately between 0.2% and 3%. If the difference between the moving speeds becomes less than 0.2%, the difference between the moving speed of the intermediate transfer belt 51 and the moving speed of the transfer conveyance belt 91 may become reversed due to the uneven rotation. On the other hand, if the difference becomes greater than 3%, an image defect in which the toner image becomes as if dragged may be generated.

Further, in the image forming apparatus according to the present exemplary embodiment, the secondary transfer portion is disposed upstream of the intermediate transfer belt drive roller 52, and the primary transfer portion is disposed downstream of the intermediate transfer belt drive roller 52. The moving speed of the photosensitive drum 1 is set greater than the moving speed of the intermediate transfer belt 51. More specifically, the moving speed of the photosensitive drum 1 is set at approximately 302 mm/sec. By such relation between the moving speeds, a surface Mg of the intermediate transfer belt 51 suspended between the photosensitive drum 1*a* and the intermediate transfer belt drive roller 52 receives a force in the direction of reducing the rotational speed of the intermediate transfer belt 51 from the photosensitive drum 1. The surfaces Mg and Me of the intermediate transfer belt 51 thus apply a winding force on the intermediate transfer belt drive roller 52 from both the upstream side and the downstream side. As a result, the possibility of generating slipping can be decreased, and the primary transfer nip N1 can be stabilized.

Further, the difference between the moving speed of the photosensitive drum 1 and the moving speed of the intermediate transfer belt 51 may be approximately between 0.2% and 3%. If the difference between the moving speeds becomes less than 0.2%, the difference between the moving speed of the photosensitive drum 1 and the moving speed of the intermediate transfer belt 51 may become reversed due to uneven rotation. On the other hand, if the difference becomes greater than 3%, an image defect in which the toner image becomes as if dragged may be generated.

Further, in the present exemplary embodiment, the transfer conveyance belt cleaner 99 is disposed downstream of the outer secondary transfer roller 57 and upstream of the transfer conveyance belt drive roller 92 with respect to the rotational direction of the transfer conveyance belt 91. The transfer conveyance belt cleaner 99 cleans the gathered toner or paper particles adhered on the transfer conveyance belt 91.

The transfer conveyance belt cleaner 99 includes a cleaning blade, i.e., a cleaning member made of urethane rubber, which press-contacts the transfer conveyance belt 91 opposing the rotational direction of the transfer conveyance belt 91. The cleaning blade thus applies a force on the transfer conveyance belt 91 in a direction of reducing the rotational speed. As a result, if the surface Mh of the transfer conveyance belt 91 receives a slackening force from the intermediate transfer belt 51 at the secondary transfer nip N2, the transfer conveyance belt cleaner 99 can block the slackening of the transfer conveyance belt 91. Therefore, the suspension of a surface Mi of the transfer conveyance belt 91 over the transfer conveyance belt drive roller 92 becomes stable, and image expansion and contraction due to slipping of the transfer conveyance belt 91 can be prevented.

According to the present exemplary embodiment, the cleaning performance can be improved with the cleaning blade 591, which press-contacts the intermediate transfer belt 51, press-contacting the drive roller 52. The intermediate transfer belt 51 includes a conventional steering mechanism that inclines the rollers between which the intermediate transfer belt 51 is stretched to adjust the position in the direction perpendicular to the moving direction of the belt. If the roller opposite the cleaning member is inclined when the steering mechanism is disposed, the cleaning performance does not become stable. In the present exemplary embodiment, such instability can be solved with a simplified configuration.

As described above, according to the present exemplary embodiment, the photosensitive drum, the secondary transfer member, and the intermediate transfer belt drive roller are disposed in this order from the upstream with respect to the rotational direction of the intermediate transfer belt. Further, the transfer conveyance belt drive roller and the secondary transfer member are disposed in this order from the upstream with respect to the rotational direction of the transfer conveyance belt.

Moreover, the moving speed of the intermediate transfer belt is set greater than the moving speed of the transfer conveyance belt. More preferably, the moving speed of the image bearing member is set greater than the moving speed of the intermediate transfer belt.

Further, the transfer conveyance belt cleaning member may be disposed downstream of the secondary transfer member and upstream of the transfer conveyance belt drive roller with respect to the rotational direction of the transfer conveyance belt.

As a result, image expansion and contraction and color misregistration due to slipping of the intermediate transfer belt and the transfer conveyance belt can be reduced in the image forming apparatus.

In the above-described exemplary embodiment, a suspension roller is not disposed between the intermediate transfer belt drive roller 52 and the inner secondary transfer roller 56.

However, if a suspension roller is disposed between the intermediate transfer belt drive roller 52 and the inner secondary transfer roller 56, the suspension roller hardly exerts a braking force on the rotation of the intermediate transfer belt 51. Therefore, the present invention can be applied to such configuration including the suspension roller.

As described above, according to the present exemplary embodiment, the image forming apparatus includes the intermediate transfer belt and the conveyance belt member in contact with the intermediate transfer belt. The rotational instabilities of the intermediate transfer belt and the conveyance belt member caused by slackening of the intermediate transfer belt and the conveyance belt member can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-149365 filed Jun. 6, 2008, which is hereby incorporated by reference herein in its entirety.

What is claimed is:

1. An image forming apparatus comprising:

an image forming unit, including a rotatable image bearing member, configured to form a toner image on the image bearing member;

a rotatable intermediate transfer belt configured to carry a toner image transferred from the image bearing member;

a rotatable conveyance belt member configured to contact the intermediate transfer belt and to convey a recording material;

a transfer member configured to contact an inner surface of the intermediate transfer belt and to form a transfer portion to transfer a toner image on the intermediate transfer belt to the conveyed recording material;

a first drive member located adjacent to and downstream of the image bearing member, and adjacent to and upstream of the transfer portion with respect to a rotational direction of the intermediate transfer belt and configured to apply a driving force to the intermediate transfer belt; and a second drive member located adjacent to and downstream of the transfer portion with respect to a direction of conveying the recording material on the conveyance belt member and configured to apply a driving force to the conveyance belt member, wherein a moving speed of the intermediate transfer belt in a rotational direction is greater than a moving speed of the image bearing member in a rotational direction, and a moving speed of the conveyance belt member in a rotational direction is greater than a moving speed of the intermediate transfer belt in a rotational direction.

2. The image forming apparatus according to claim 1, further comprising a cleaning member configured to contact the intermediate transfer belt and to remove toner remaining after the toner image on the intermediate transfer belt is transferred to the recording material.

3. The image forming apparatus according to claim 2, wherein the cleaning member is located downstream of the transfer portion and upstream of the image bearing member with respect to the rotational direction of the intermediate transfer belt.

4. The image forming apparatus according to claim 3, wherein the cleaning member is set to apply a force in a direction of reducing a rotational speed of the intermediate transfer belt.

5. The image forming apparatus according to claim 1, further comprising:

a fixing unit configured to fix the toner image, wherein the second drive member is located upstream of the fixing unit with respect to the direction of conveying the recording material.

6. An image forming apparatus comprising:

an image forming unit, including a rotatable image bearing member, configured to form a toner image on the image bearing member;

a rotatable intermediate transfer belt configured to carry a toner image transferred from the image bearing member;

a rotatable conveyance belt member configured to contact the intermediate transfer belt and to convey a recording material;

a transfer member configured to contact an inner surface of the intermediate transfer belt and to form a transfer portion to transfer a toner image on the intermediate transfer belt to the conveyed recording material;

a first drive member located adjacent to and upstream of the image bearing member, and adjacent to and downstream of the transfer portion with respect to a rotational direction of the intermediate transfer belt and configured to apply a driving force to the intermediate transfer belt; and a second drive member located adjacent to and upstream of the transfer portion with respect to a direction of conveying the recording material on the conveyance belt member and configured to apply a driving force to the conveyance belt member, wherein a moving speed of the intermediate transfer belt in a rotational direction is greater than a moving speed of the conveyance belt member in a rotational direction and a moving speed of the image bearing member in a rotational direction is greater than a moving speed of the intermediate transfer belt in a rotational direction.

7. The image forming apparatus according to claim 6, further comprising a cleaning member configured to contact the intermediate transfer belt and to remove toner remaining after the toner image on the intermediate transfer belt is transferred to the recording material.

8. The image forming apparatus according to claim 7, wherein the cleaning member is located downstream of the transfer portion and upstream of the image bearing member with respect to the rotational direction of the intermediate transfer belt.

9. The image forming apparatus according to claim 8, wherein the cleaning member is set to apply a force in a direction of reducing a rotational speed of the intermediate transfer belt.

10. The image forming apparatus according to claim 6, wherein the first drive member is located next to the transfer portion and the second drive member is located next to the transfer portion.

11. The image forming apparatus according to claim 6, further comprising:

a container configured to contain a recording material, wherein the second drive member is located downstream of the container with respect to the direction of conveying the recording material.

* * * * *